United States Patent [19]

Seabrook

[11] 3,977,268

[45] Aug. 31, 1976

[54] FEED ROLL DRIVE

[76] Inventor: William B. Seabrook, 1141 Woodvale Ave., Gastonia, N.C. 28052

[22] Filed: Apr. 4, 1975

[21] Appl. No.: 565,063

[52] U.S. Cl. ..... 74/417; 19/105; 74/396

[51] Int. Cl.[2] ..... F16H 1/14; F16H 35/06; D01G 15/40

[58] Field of Search ..... 74/396, 417 U, 421 R; 19/105

[56] References Cited

UNITED STATES PATENTS 1,512,267 10/1924 Arnold, Jr. ..... 19/105

FOREIGN PATENTS OR APPLICATIONS 501,367 7/1930 Germany

*Primary Examiner*—Leonard H. Gerin
*Attorney, Agent, or Firm*—Bailey & Dority

[57] ABSTRACT

This invention relates generally to textile carding machines and the like, and more particularly to a drive apparatus for driving a feed roll on such a machine so that a constant drive speed is provided and so the drive speed may be conveniently altered by exchanging gears of different ratios, wherein the drive apparatus includes a bracket having at least one vertical side member and a transfer shaft adjustably carried within the vertical side member. A first gear, which is driven by a drive bevel gear carried on a main input shaft, is carried on the transfer shaft, and a draft change gear is removably carried on the transfer shaft for rotation with the first gear. The draft change gear is meshed with a feed roll change gear which is carried on the feed roll drive shaft for driving the feed roll. The draft change gear and the feed roll change gear may be readily removed and replaced to alter the gear ratio of the drive apparatus and the drive speed of the feed roll with the transfer shaft being adjustable to accommodate the change of the gears.

3 Claims, 3 Drawing Figures

FEED ROLL DRIVE

BACKGROUND OF THE INVENTION

Normally, the feed roll on a carding machine is driven by a small beveled draft gear which meshes with a large beveled gear having a diameter, for example, of approximately 13 inches which is mounted on the feed roll drive shaft. Such a drive arrangement is shown in U.S. Pat. No. 1,512,267. Normally, these gears are cast and are not precision gears producing uneven wearing and warpage of the gears in continued operation. To provide a precision gear the size of the large diameter gear would require a skilled machinist at a high cost.

The feed roll operates to feed the cotton to the main cylinder of the carding machine and it is desirable that the feed roll operate at a slow and constant speed so as to feed the cotton at a low rate of constant speed into the card so that the card has sufficient time in which to spread the cotton into an even sheet for uniformly charging the main cylinder. The above mentioned warping and uneven wearing of the conventional drive arrangements often produces variations in the speed at which the feed roller is driven, and it has not been possible to control the speed of the feed roller accurately.

In addition, it is often desirable to change the speed at which the feed roll is driven by replacing the small draft gear and the large beveled gear as a matched pair with a pair of gears of different gear ratio. However, a large beveled gear of such size, even when made by casting involves considerable cost and coupled with the fact that such a gear often becomes unevenly worn or warped results in an undesirable drive arrangement.

SUMMARY OF THE INVENTION

A drive apparatus is provided for driving a feed roll on a carding machine and the like comprising a bracket carried by the carding machine having at least one vertical side member with an elongated longitudinal slot formed therein. A transfer shaft extends through the longitudinal slot and is carried for longitudinal adjustment in the slot. A first gear is carried on the transfer shaft and means for driving the first gear are provided in a conventional manner. A draft change gear is carried on the transfer shaft for rotation with the first gear, and is in meshing relationship with a feed roll change gear carried on the feed roll drive shaft for driving the feed roll. The draft change gear and the feed roll change gear may be readily removed and replaced with different size gears to alter the gear ratio of the drive apparatus and vary the speed of the feed roll with the transfer shaft being adjustable longitudinally in the longitudinal slot formed in the vertical side member to accommodate the change of the different size gears.

Accordingly, an important object of the present invention is to provide a gear drive apparatus for driving a feed roll on a carding machine at a constant rate of speed.

Another important object of the present invention is to provide a gear drive apparatus for driving a feed roll on a carding machine which utilized a plurality of smaller machined gears in place of the conventional cast feed roll beveled gear for providing speed accuracy and reliability.

Another important object of the present invention is to provide a gear drive apparatus for driving a feed roll on a carding machine wherein the gears may be readily and conveniently exchanged to vary the speed of the feed roller.

Another important object of the present invention is to provide a gear drive apparatus for driving a feed roll on a carding machine which utilizes a bracket mounted on the side of the carding machine for adjustably carrying the gear drive apparatus so as to accomodate different size gears.

The construction designed to carry out the invention will be hereinafter described, together with other features thereof.

The invention will be more readily understood from a reading of the following specification and by reference to the accompanying drawing forming a part thereof, wherein an example of the invention is shown and wherein:

DESCRIPTION OF A PREFERRED EMBODIMENT

Figure 1:
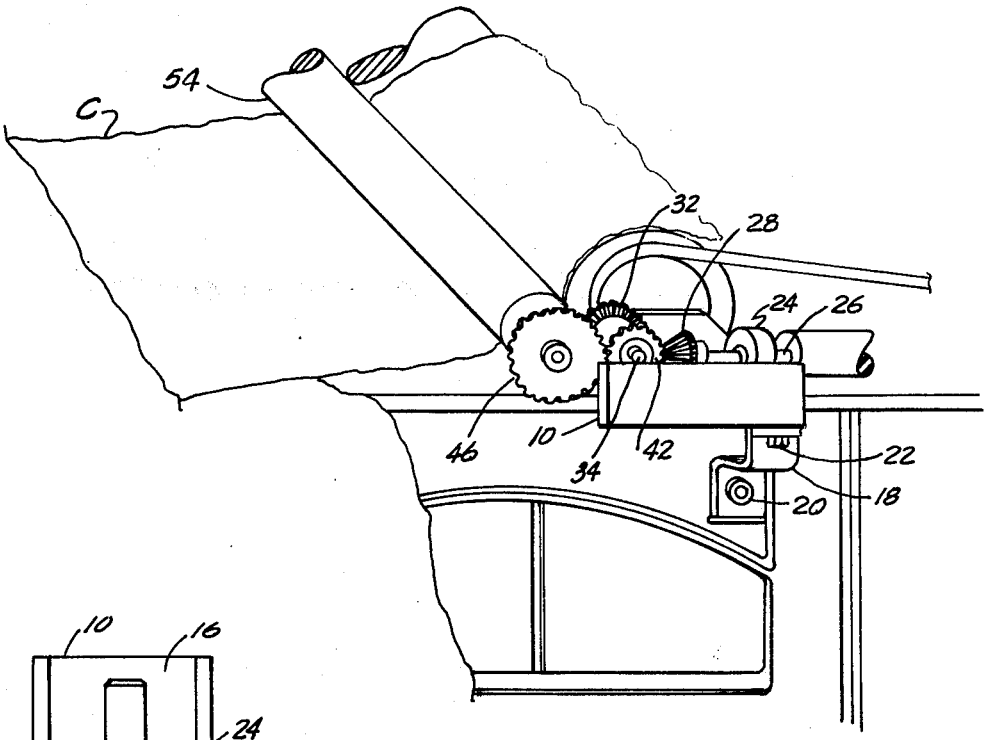
FIG. 1 is a perspective view illustrating a feed roll drive and bracket constructed in accordance with the present invention.
Figure 2:
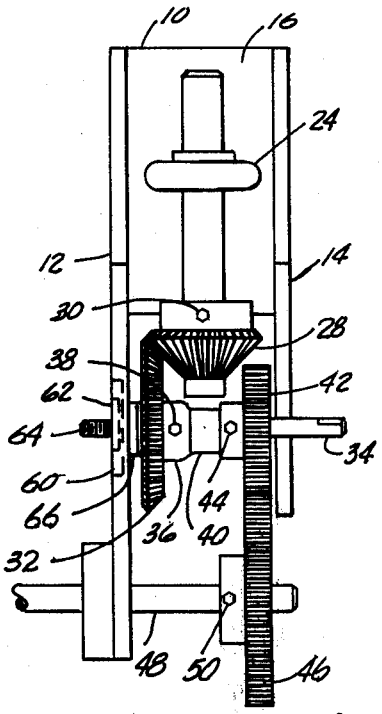
FIG. 2 is a top plan view of the feed roll drive and bracket of FIG. 1 with parts of the driven rollers omitted.
Figure 3:
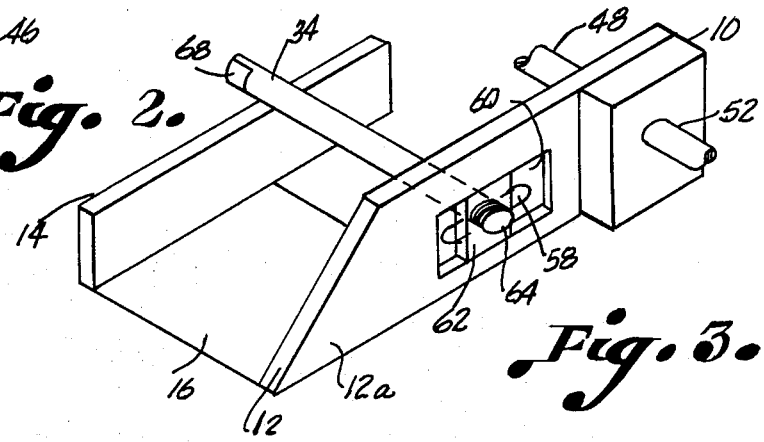
FIG. 3 is a rear perspective view of the feed roll drive bracket, constructed in accordance with the present invention, illustrating the back side of the bracket with parts of the feed roll drive gears omitted.

This invention relates to a transmission drive for driving a feed roll on a carding machine. A carding machine receives bulk cotton in the form of laps or sheets and processes the cotton into cotton sliver to be further processed into yarn. The quality of a sliver depends on the efficiency and perfection of the operation of the carding machine. An important aspect of this operation is that the feed roll, which feeds the cotton sheets to uniformly charge the main cylinder of the carding machine, be driven at the most perfectly attainable constant speed without variations. The feed roll is usually driven at a relatively low rate of speed and it is desirable to be able to conveniently alter the speed by changing the ratio of the gears driving the feed roll.

The present invention provides an improved feed roll drive apparatus which affords an accurate drive at a constant speed for the feed rolls, and affords an expedient exchanging of gears to alter the speed at which the feed roll is driven.

Referring now to the drawing, the feed roll drive apparatus comprises a bracket 10 carried by the carding machine, having a vertical side member 12, an opposing vertical side member 14 and a horizontal base member 16 extending between the vertical side members. The bracket 10 is fastened to the side of the carding machine by a bracket 18 in any conventional manner such as by bolt member 20 and the brackets 18 and 10 are secured together by any suitable fastening means such as bolt 22. The bracket 10 supports and carries the gear arrangement which drives the feed roll and provides a quick and convenient exchange of gears to alter the gear ratio of the drive apparatus in a manner to be more fully explained later.

A bearing block 24 is carried by the bracket on its horizontal base 16 and a main input drive shaft 26 is rotatably carried in the bearing block 24. A drive bevel gear 28 is carried on the end of the input drive shaft 26 and is secured thereto by a conventional set screw 30 allowing the drive bevel gear to be slidably positioned on the input drive shaft. The main input drive shaft 26 is driven in a conventional manner by a gear take-off drive arrangement from the doffer roller of the carding machine (not shown).

The drive bevel gear meshes with a bevel gear 32 rotatably carried on an immediate transfer shaft 34. The beveled gear 32 has an outwardly extending collar member 36 which extends axially over the transfer shaft 34 and is affixed thereto by a conventional set screw 38. The collar member 36 then tapers into a reduced collar portion 40 which is reduced in diameter to that of the collar portion 36 for receiving a draft change gear 42 slidably thereon. The draft change gear 42 is affixed to the reduced collar portion 40 by a conventional set screw 44 and the draft change gear 42 then rotates with the beveled gear 32. The intermediate transfer shaft 34 is carried in the vertical side 12 of the bracket 10.

The draft change gear 42 meshes with a feed roll change gear 46 which is mounted on the end of the feed roll drive shaft 48 and is affixed thereto in any suitable manner such as by set screw 50. The feed roll drive shaft extends through a suitable bushing or opening 52 in the vertical side member 12 of bracket 10 and is further supported by the carding machine itself in a conventional manner. The feed roll 54 is carried for rotation on the feed roll drive shaft in a conventional manner for feeding the sheets of cotton C into the carding machine.

The draft change gear 42 and the feed roll change gear 46 are spur type gears which may be machined from hardened steel and which may be readily replaced in pairs to alter the gear ratio and, hence, the speed at which the feed roll is driven. The smaller machined spur gears 42 and 46 replace the conventional large diameter bevel gear and small beveled gear arrangement which drive the feed roll in a conventional carding machine such as in the previously referred to U.S. Pat. No. 1,512,267. In one embodiment, for example, spur gears 42 and 46 are 1¾ and 6½ inches in diameter, respectively, as compared to the 13 inch diameter beveled gear conventionally used. The use of the spur gears 42 and 46 machined from hardened steel result in a more accurate control of the speed at which the feed roll is driven and such gears do not have as much tendency to wear unevenly and warp as does the larger diameter bevel gear which is usually cast, such as from iron and the like.

The intermediate transfer shaft 34 is received through a longitudinal slot 58 which is formed in a substantially rectangular counter-sunk hole 60 formed in the back side 12*a* of the vertical side member 12. A substantially squared nut member 62 is received over the threaded end 64 of the transfer shaft 34. When the transfer shaft 34 is loosened in the nut member 62, the transfer shaft may be slidably adjusted longitudinally in the longitudinal slot 58 and the square nut member 62 may be slidably adjusted longitudinally in the rectangular counter-sunk hole member 60 therewith. In this manner, the transfer shaft 34 may be adjusted longitudinally in the bracket so as to accommodate the changing of the draft change gear 42 and the feed roll change gear 46 in pairs to alter the gear ratio of the drive apparatus. The drive bevel gear 28 may be slidably positioned on the main input drive shaft 26 so as to accommodate the adjustment of the transfer shaft 34 and the differently sized gears. The transfer shaft 34 includes a flanged collar member 66 which abuts the vertical side member 12 as the threaded end 64 of the transfer shaft extends through the longitudinal slot 58 so that the transfer shaft may be tightened in the square nut 62 and held stationary in the vertical side member 12 once it is adjusted to the desired longitudinal position. The transfer shaft 34 further has a flat end portion 68 which allows for a wrench or other suitable tool to be received over the end of the shaft to tighten and loosen it in the square nut 62.

In use, when it is desired to alter the speed at which the feed roll is driven, the draft change gear 42 and the feed roll change gear 46 may be exchanged with spur gears of different gear ratios. The drive bevel gear 28 and the bevel gear 32 carried on the transfer shaft 34 remain as standard parts of the entire gear train. The relative longitudinal position of the transfer shaft 34 and the position of the drive bevel gear 28 on the main input shaft 26 are adjusted so as to accommodate the changing of the spur gears. In this manner, a feed roll drive apparatus is provided wherein the speed of the feed roll may be altered in a convenient and expedient manner.

As mentioned previously, the precision spur gears 42 and 46 are machined from hardened steel, and replace the conventional gear drive arrangement which employed a rather large diameter beveled gear made by casting. Although the smaller spur gears 42 and 46 require machining as opposed to casting, they are relatively inexpensive compared to the single large beveled gear, minimizing the expense required to alter the speed of the feed roll by exchanging gears.

The machined spur gears 46 and 42 drive the feed roll in a more accurate manner providing a constant rate of speed without variations.

Thus, a feed roll drive apparatus is provided for driving the feed roll at a constant rate of speed providing a uniform charging of the carding machine with cotton, while still affording convenient exchanging of the gears to alter the gear ratio and thus the speed of the feed roll.

While a preferred embodiment of the invention has been described using specific terms, such description is for illustrative purposes only, and it is to be understood that changes and variations may be made without departing from the spirit or scope of the following claims.

What is claimed is:

1. Drive apparatus for driving a feed roll on a carding machine and the like comprising:

a bracket carried by said carding machine having at least one vertical side member, an elongated longitudinal slot formed in said vertical side member of said bracket, a transfer shaft having one end carried in said slot extended substantially perpendicular from said vertical side member and said slot, said one end being movable in said slot for adjusting the position of said transfer shaft along the length of said slot;

a first gear carried on said transfer shaft, means for driving said first gear, a draft change gear carried on said transfer shaft for rotation with said first gear, a feed roll drive shaft carried by said carding machine for driving said feed roll, and a feed roll change gear in meshing relationship with said draft change gear carried by said feed roll drive shaft, whereby said feed roll change gear and said draft change gear may be readily removed and replaced to alter the gear ratio of said drive apparatus and vary the drive speed of said feed roll with said transfer shaft being adjustable longitudinally in said slot so as to accommodate the change of the different size gears.

2. The apparatus of claim 1 further comprising: said transfer shaft including a threaded end extending past a backside of said vertical side member, a substantially rectangular counter-sunk hole formed in said backside of said vertical side member having said elongated longitudinal slot formed therein, fastening means receivable in said rectangular hole and over the threaded end of said shaft for securing said transfer shaft to said vertical side member whereby said fastening means may be loosened so as to permit longitudinal adjustment of said transfer shaft in said longitudinal slot and said fastening means in said rectangular hole.

3. The apparatus of claim 1 wherein said means for driving said first gear includes a bearing block carried by said bracket, a main input shaft carried by said bearing block extending therethrough, a drive gear carried on one end of said main input shaft, and said drive gear being in meshing relationship with said first gear for driving said first and said draft change gears carried on said transfer shaft.

* * * * *